US006527353B1

(12) United States Patent
Bradfish et al.

(10) Patent No.: US 6,527,353 B1
(45) Date of Patent: Mar. 4, 2003

(54) LATCH HANDLE FOR DOORS AND DRAWERS

(76) Inventors: Darrell R. Bradfish, 4607-B Camp Phillips Rd., Schofield, WI (US) 54476; Tracey M. Geurts, 10102 Pheasant Run Ct., Schofield, WI (US) 54476; Jay A. Jaecks, 4905 Shirley La., Schofield, WI (US) 54476

( * ) Notice: Subject to any disclaimer, the term of this patent is extended or adjusted under 35 U.S.C. 154(b) by 3 days.

(21) Appl. No.: 09/658,279

(22) Filed: Sep. 8, 2000

(51) Int. Cl.[7] ..... A47B 88/00

(52) U.S. Cl. ..... 312/332.1; 312/333; 292/102; 292/126; 292/128

(58) Field of Search ..... 312/332.1, 333, 312/319.1, 222, 217; 292/118, 120, 29, 126, 128, 102

(56) References Cited

U.S. PATENT DOCUMENTS

| | | | | | |
|---|---|---|---|---|---|
| 413,245 | A | * | 10/1889 | Richmond | 292/128 X |
| 813,376 | A | * | 2/1906 | Greenwood | 292/128 X |
| 1,521,572 | A | * | 12/1924 | Hammer et al. | 292/128 X |
| 1,642,501 | A | * | 9/1927 | Knell | 312/332.1 X |
| 2,197,195 | A | * | 4/1940 | Schemers | 292/128 |
| 2,946,640 | A | * | 7/1960 | Sitler | 312/332.1 |
| 3,003,202 | A | | 10/1961 | Mendelsohn | |
| 3,031,248 | A | * | 4/1962 | Jeeves | 312/332.1 |
| 3,218,112 | A | * | 11/1965 | Stark | 312/333 |
| 3,239,298 | A | | 3/1966 | McCarthy | |
| 3,252,746 | A | | 5/1966 | Kafferlin et al. | |
| 3,294,463 | A | | 12/1966 | Kafferlin et al. | |
| 3,338,610 | A | * | 8/1967 | Pelcin et al. | 292/126 |
| 3,450,453 | A | * | 6/1969 | Tazaki | 312/222 |
| 4,302,037 | A | | 11/1981 | Nunez | |
| 5,165,737 | A | | 11/1992 | Riegelman | |
| 5,292,191 | A | | 3/1994 | Slivon | |
| 5,403,139 | A | | 4/1995 | Slivon et al. | |
| 5,603,535 | A | | 2/1997 | Antonucci et al. | |
| 5,775,140 | A | | 7/1998 | Hallsten | |
| 5,868,478 | A | * | 2/1999 | Yemini | 312/332.1 |
| 6,161,909 | A | * | 12/2000 | Huang | 312/222 X |
| 6,296,334 | B1 | * | 10/2001 | Liao | 292/128 X |

FOREIGN PATENT DOCUMENTS

| | | | | |
|---|---|---|---|---|
| CA | 568243 | | 12/1958 | |
| GB | 866109 | | 4/1961 | |
| JP | 03156083 | * | 7/1991 | 292/128 |
| JP | 06189832 | * | 7/1994 | 312/333 |

* cited by examiner

*Primary Examiner*—Lanna Mai
*Assistant Examiner*—Hanh V. Tran
(74) *Attorney, Agent, or Firm*—Richard C. Litman

(57) ABSTRACT

A latch handle for doors and drawers for latching construction elements such as windows and doors. The latch handle may be located on the upper front edge portion of a drawer or the midportion of a door and may be manually opened by reaching under the front edge portion or trim member of the handle and pressing upwards on an actuator bar located inside the frame of the handle. The handle provides an aesthetic advantage in that the latch mechanism is concealed behind the front panel of the drawer or behind the door. The latching mechanism is made up of an actuator bar, a connecting link, and a hook. The hook is configured to engage with a keeper. At least one spring is fixedly attached to the frame for urging the actuator downwards and for carrying the hook into a reliable and secure engagement with the actuator.

13 Claims, 4 Drawing Sheets

LATCH HANDLE FOR DOORS AND DRAWERS

BACKGROUND OF THE INVENTION

1. Field of the Invention

The present invention relates generally to locks and more particularly to latch mechanisms adapted to regulate the locking of doors and drawers.

2. Description of the Related Art

Numerous apparatuses have been devised for providing enhanced locking mechanisms for various construction elements such as windows, doors, and drawers. Over the years, some of the most significant advances have involved the development of latch fasteners which are configured to cooperate with a fixedly secured striker member for selectively locking and unlocking a door or drawer. However, none of the references described hereinbelow provides a concealed latch mechanism which allows a user to easily open a door or drawer with one hand, while reliably and securely fastening the door or drawer when in closed position. For example, U.S. Pat. No. 5,403,139, issued to Slivon et al., presents a latch mechanism which includes a drawer pull at the front of the drawer. Under the top flange of the drawer pull is located a channel in which a latch bar is slidably movable from side to side. One end of the latch bar carries a hook which is spring loaded in the latched position. When it is desired to open the drawer, the user places his fingertips beneath the pull and against the latch bar and moves the slide bar to its unlatched position.

U.S. Pat. No. 3,239,298, issued to McCarthy, discusses a combination drawer pull and latch mechanism adapted to regulate the locking structure provided to secure a file drawer, or the like, within its associated cabinet structure. And U.S. Pat. No. 3,252,746, issued to Kafferlin, presents a filing cabinet and latching mechanism comprising a handle that incorporates a finger actuated latch mechanism by which the operator may release the drawer for withdrawal from a closed or confined configuration.

U.S. Pat. No. 4,302,037, issued to Nunez, relates to a latch fastener for construction elements such as windows, doors or the like, which includes a base member and a movable member, having a latching hook configured to cooperate with a fixedly secured striker plate for selectively locking and unlocking the window or door. The members have positioned therebetween several bearing balls which facilitate movement of the movable member and a latching hook relative to the base member between at least two positions corresponding to the locked and unlocked positions of the window or door.

U.S. Pat. No. 5,165,737, issued to Riegelman, discloses a housing with a top wall, upstanding posts between the upstanding parallel walls, and two upstanding posts between the upstanding walls on a line parallel with the walls. Each post extends through an elongated opening in a first bolt which is mounted slidingly in the housing for reciprocation toward first and second ends of the housing. The bolt is extendible beyond the second ends of the housing for engaging a window jamb when the housing is mounted on a sash of a tilt window that is fully seated in the jamb. The bolt is urged toward the second end by a spring in one of the elongated openings, bearing on the bolt and the post in the opening.

U.S. Pat. No. 5,292,191, issued to Slivon, relates to a latch mechanism including a trim member secured to a drawer pull at the front of the drawer. An actuator plate is located under the drawer pull and is disposed in a slot of a trim member on the drawer pull. A keeper is located on a side wall of the cabinet adjacent the hook. A hook is attached to one end of the actuator plate and is arranged to engage the keeper when the drawer is closed. The hook is releasable from the keeper by pivoting the actuator plate toward the drawer pull to open the drawer.

U.S. Pat. No. 5,603,535, issued to Antonucci et al., discusses a slam latch for securing a slidable window or door to a corresponding frame consisting of a housing including a base plate, a catch, and a keeper, wherein the catch is spring biased downward against the housing so as to become operatively engaged with the keeper when the door or window is moved to a closed position, causing the catch and keeper to become in juxtaposition to one another.

U.S. Pat. No. 5,775,140, issued to Hallsten, relates to a lock for cassettes for the construction of drawer cabinets, including a frame structure which carries a locking bar passing through an opening in a frontal part of the drawer, the bar being turnable and projecting from the inside of the frontal part. A handle connected to the bar is also included. At least one fixed projection is connected to the frame structure. The projection extends from the back side of the frontal part, the locking bar being, by turning the handle, movable between a locking turned-up position in which the bar engages behind an upper vertical flange of the frontal frame of the cassette and a liberating turned-down position in which the bar is located below the upper side of the projection.

U.S. Pat. No. 3,003,202, issued to Mendelsohn, discloses a window sash construction having a side member and a cross member interengaged by a lock to form a corner of the sash, the side member having a cross sectional configuration comprising a channel. The cross member ha s a cross sectional configuration comprising a third channel normal to two other channels, including a cross web and bottom wall forming opposite sides of the third channel and an outer wall interconnecting the sides.

Canadian Patent (CA 568,243), granted to Anthony, discloses a drawer for a filing cabinet or the like having a drawer body and a front plate, characterized in that a portion of the front plate is depressed to define a recessed handle formation. The depressed portion has an open side and a latch mechanism for the door mounted in spaced relation to the depressed portion and presenting a finger contact surface along the open side. And finally, British Patent (BR 866,109) granted to Jeeves, illustrates improvements in or relating to sliding drawers, shelves, or other sliding structures for cases, cabinets, or the like.

None of the above inventions and patents, taken either singularly or in combination, is seen to describe the instant invention as claimed. Thus a handle for doors and drawers solving the aforementioned problems is desired.

SUMMARY OF THE INVENTION

The latch handle for doors and drawers according to the invention is directed to an apparatus for latching construction elements such as windows and doors. In the preferred embodiment of the invention, the latch handle is fixedly disposed on the upper front edge portion of each drawer of a cabinet and is manually actuated by reaching under the front edge portion of the handle and pressing upwards on an actuator bar located inside the frame of the handle. When a user presses upwardly on the actuator bar, at least one hook, which is fixedly attached thereon, is caused to be upwardly displaced from engagement with a keeper.

The invention provides an aesthetic advantage in that the latch mechanism is concealed behind the front panel of the drawer so that, when the drawer is viewed from the front, the viewer sees only the front portion of the handle and the front panel with the rectangular opening in which the handle sits. And because the latching mechanism is hidden, almost any kind of keeper may be used. The latching mechanism is made up principally of three operative parts including the actuator bar, a connecting link, and the hook. The elongated actuator bar is preferably L-shaped in cross-section and dimensioned to be received in the frame. The actuator bar also has an upper and lower leg, the upper leg having an upper surface for supporting at least one spring thereon.

In the preferred embodiment of the invention, the outer frame of the handle is generally C-shaped and elongated and includes an upper wall, a lower wall, and a back. The upper wall has an inner surface and defines a lip or trim member which extends substantially downwardly and inwardly to create a space within the frame for nesting the spring securely therein. The spring has an inner diameter, a top portion, and a bottom portion, the inner diameter being greater at the top portion than at the bottom portion, a shape which helps to insure the spring is stable and remains in place under the trim member. The spring is fixedly attached to the inner surface of the upper wall by a fastener.

The lower wall of the frame includes at least one aperture for receiving a bolt and for mounting the frame to a support structure. The back of the frame includes at least one elongated oval slot for receiving a bolt therethrough for interconnecting the hook to the actuator bar to allow the hook to slide along the length of the slot. The hook is configured to frictionally engage with the keeper. The spring acts to urge the actuator downwards, reversibly holding the hook in engagement with the keeper.

Accordingly, it is a principal object of the invention to provide a latch mechanism for doors and drawers which requires only one hand to use.

It is another object of the invention to provide a latch mechanism for doors and drawers which is substantially concealed.

It is a further object of the invention to provide a latch mechanism for doors and drawers which is reliable and secure.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to an apparatus for latching construction elements such as windows and doors. The preferred embodiment of the invention is depicted in FIGS. 1–3 and is generally referenced by numeral 10.

For many people, one of the most difficult tasks of ordinary living entails the opening and closing of doors and drawers. Most everyone has experienced the challenge of having to open a door with only one hand. This can be especially difficult when the other hand is preoccupied with various articles such as a bag of groceries or a child. Latching mechanisms and handles are an absolutely necessary part of domestic life and an indispensable part of every household. Nevertheless, these seemingly simple objects can present major obstacles in the lives of many people. Compounding this problem is the fact that many conventional latching mechanisms are unattractive in appearance or inadequate to secure doors and drawers in their respective retaining structures. Thus, a real need exists for an attractive, reliable, and secure handle for doors and drawers, which may be easily manipulated through a minimum of manual contact.

Figure 1:
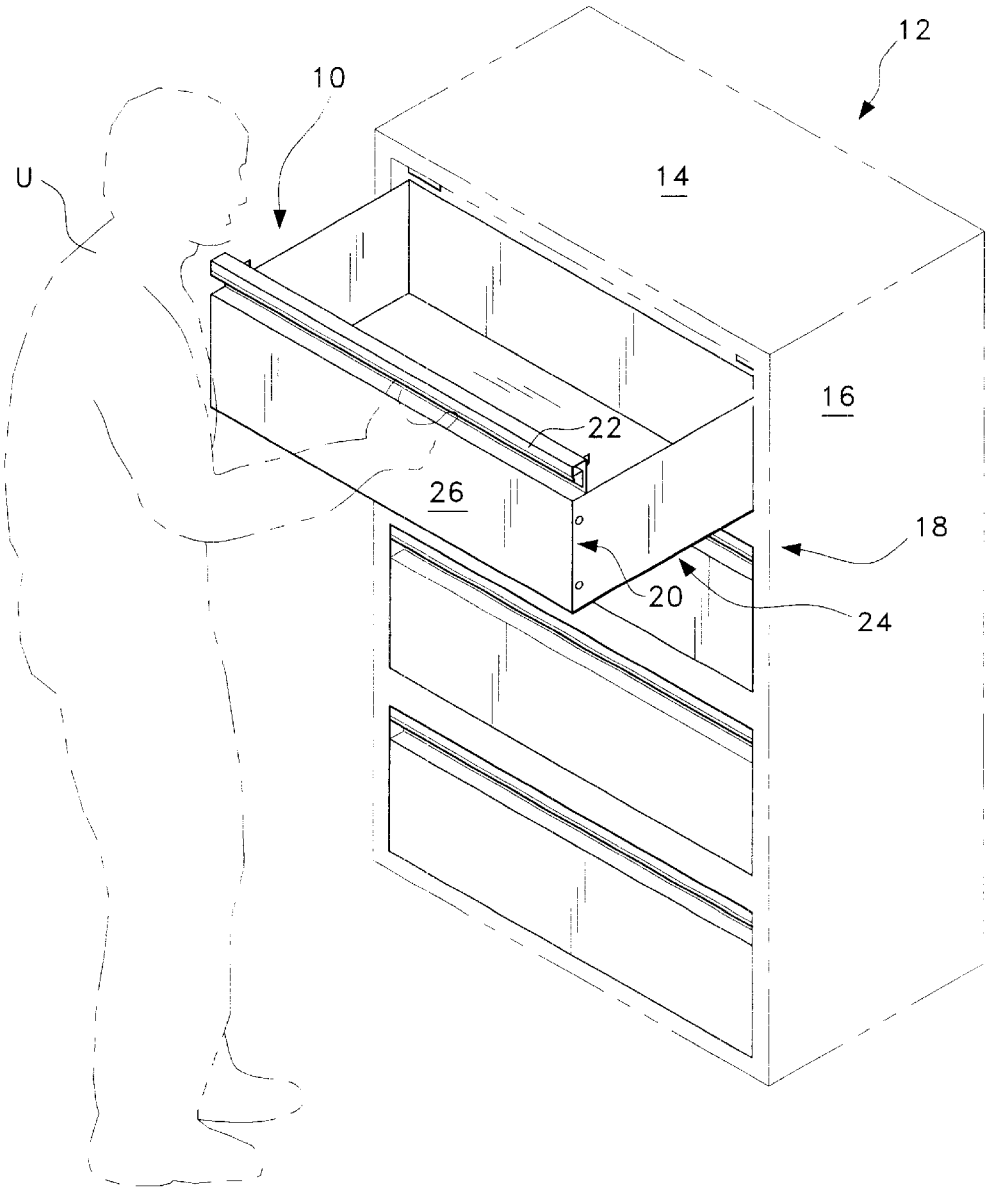
FIG. 1 is an environmental, perspective view of a latch handle for doors and drawers according to the present invention.

The latch handle for doors and drawers is particularly well suited for use in many structures, such as the filing cabinet 12 shown fitted with the handle 10, illustrated in FIG. 1. The filing cabinet is provided with top 14, bottom (not shown), and side walls, generally 16, along with the usual drawer receptacles 18 conventionally supported on door guides. In the preferred embodiment of the invention, the handle 10 for doors and drawers is located on the upper front edge portion 20 of each drawer 18. A user U is shown in ghost lines manually opening the top drawer of the cabinet by reaching under the upper front edge portion or trim member 22 of the handle 10 and pressing upwards on an actuator bar located inside the frame of the handle.

Figure 2:
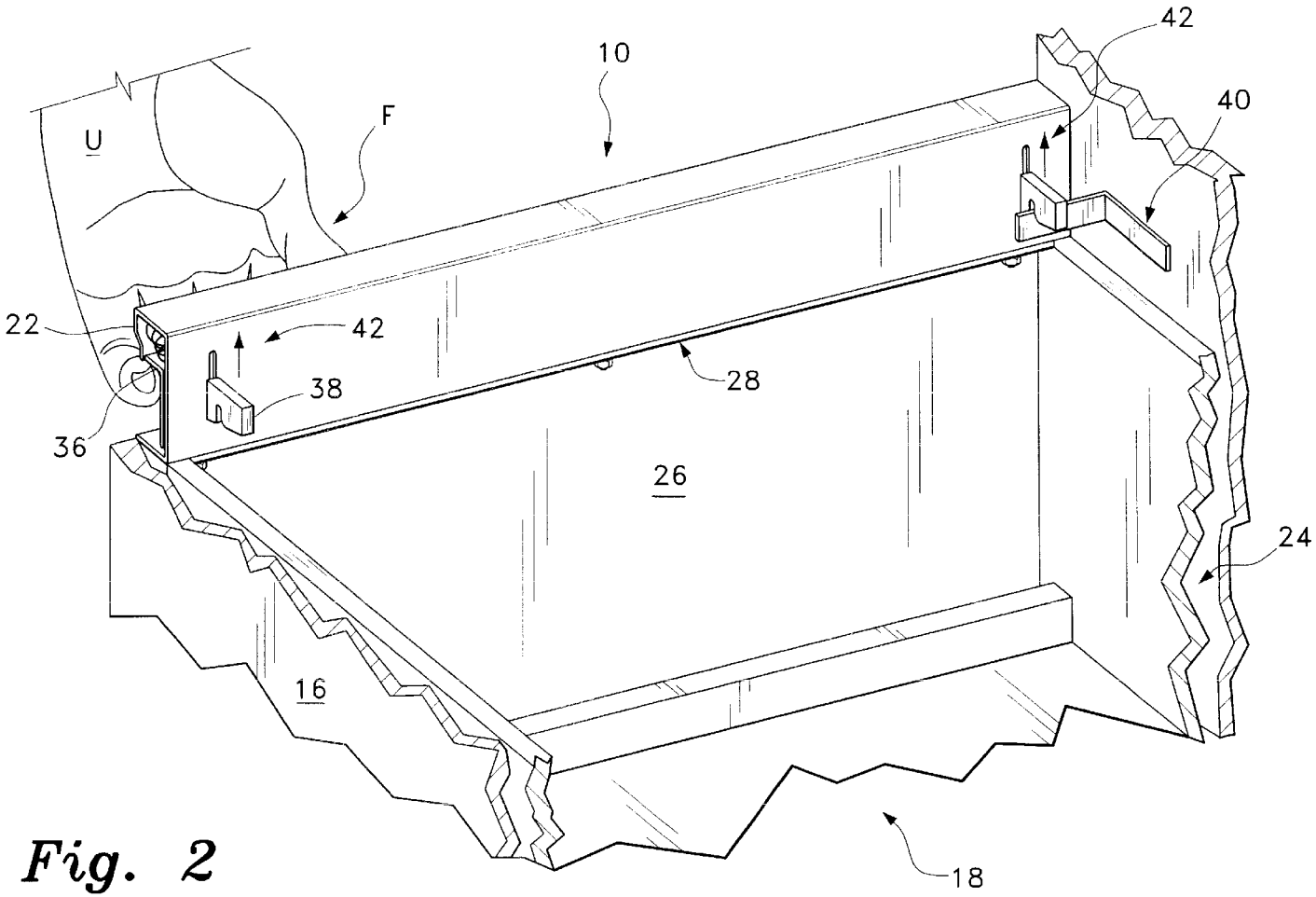
FIG. 2 is a cut away view of the latch handle for drawers and doors, according to the invention.
Figure 3:
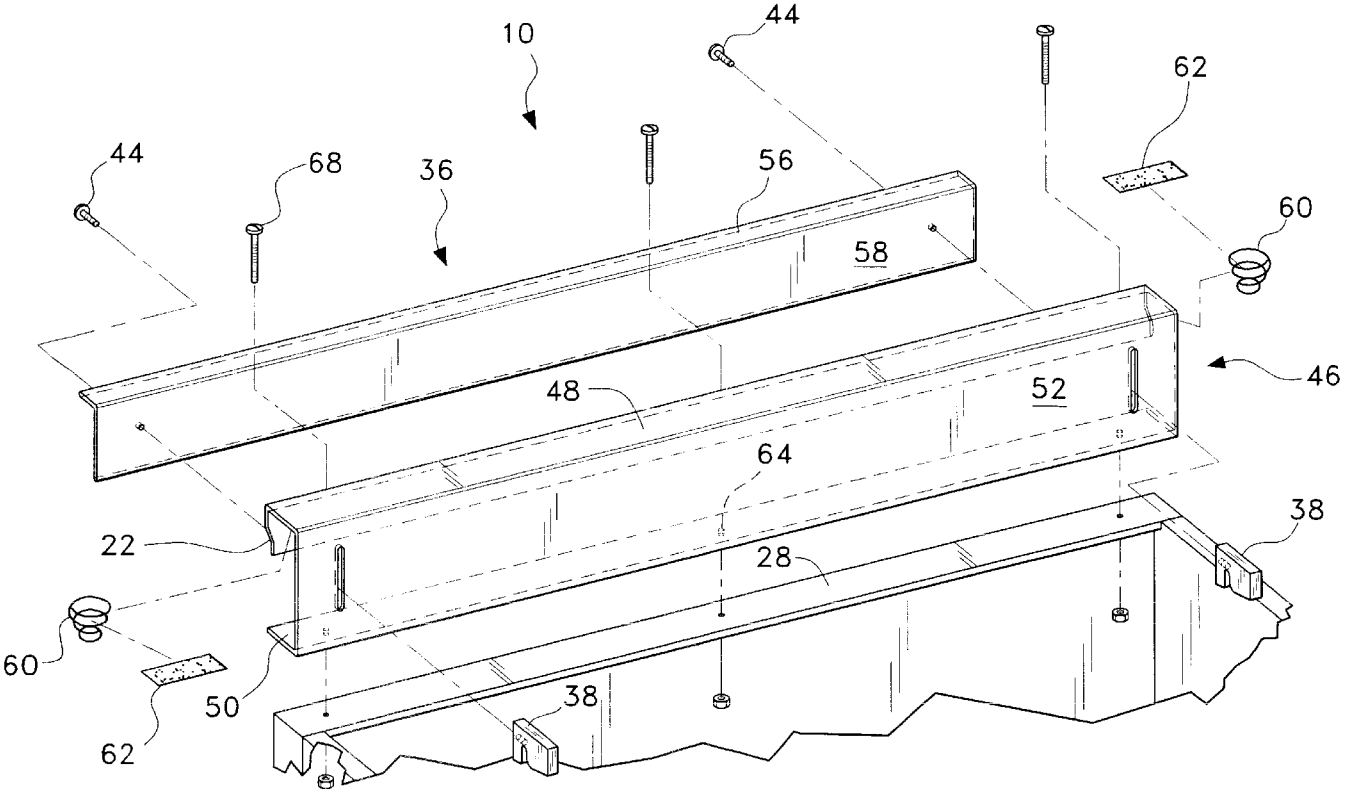
FIG. 3 is an exploded view of the latch handle for drawers and doors, according to the invention.

Turning now to FIG. 2, the drawer 18 includes a drawer body 24 and a front plate 26, and the front plate 26 defines a structure for mounting the handle 10. In the preferred embodiment, this structure 28 is provided as a cross piece extending behind the front plate 26 to define a generally planar support surface, and may be made of any suitably strong and durable material, though the handle 10 is preferably made of lightweight steel or aluminum.

Figure 4:
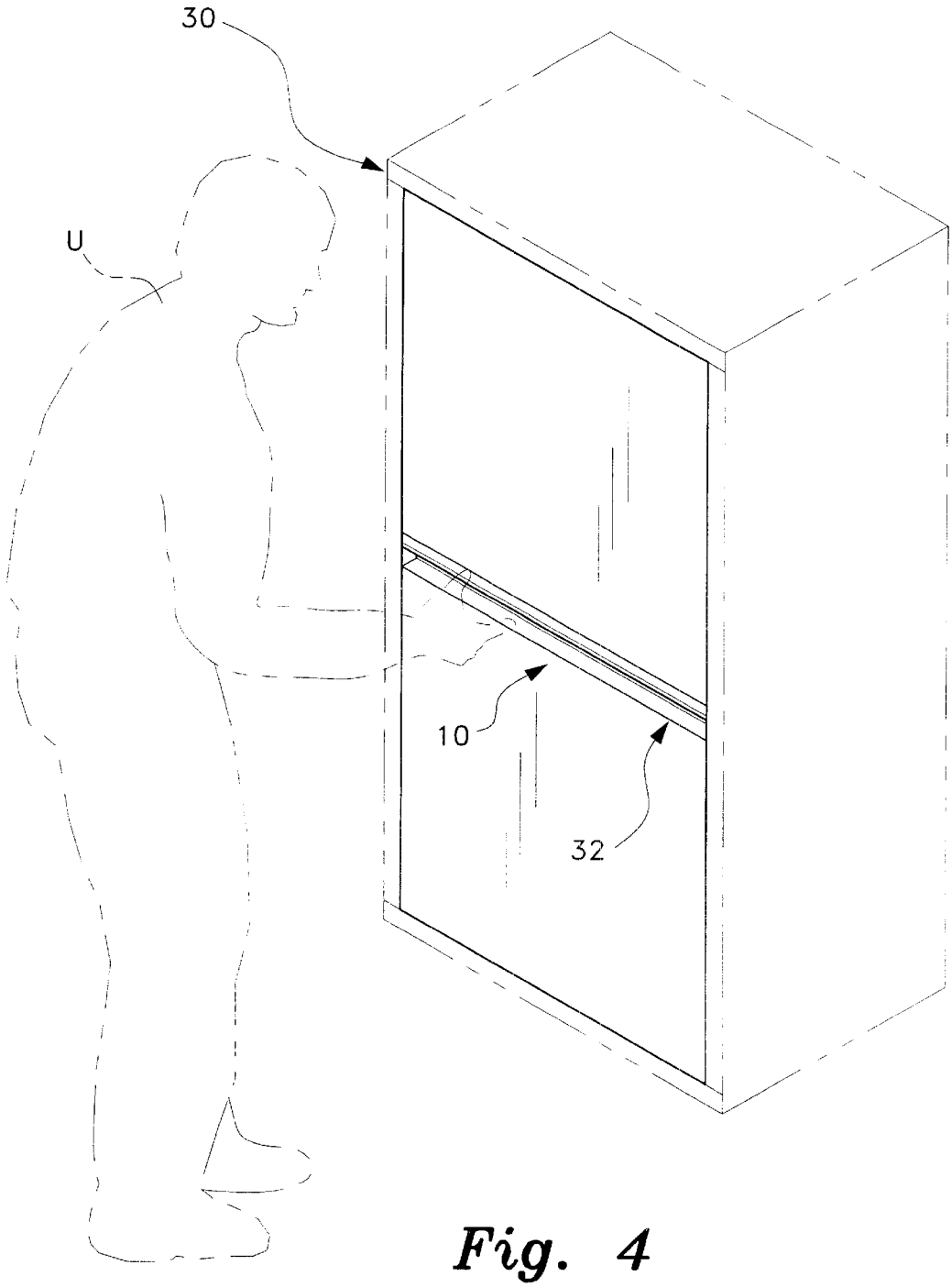
FIG. 4 is an environmental view of a second embodiment of the latch handle for doors and drawers, according to the invention.

In comparison, and as shown in FIG. 4, the handle 10 may also be incorporated into the body or frame of a larger sized door 30, and mounted on a planar support structure configured in the door 30, indicated at 32, similar to the structure 28 observed in the embodiment designed for drawers 18.

Referring again to FIG. 2, showing a rear view of the drawer 18 of the cabinet 16 with the rear portions thereof removed, it may be more fully appreciated how the handle 10 cooperates with the various structures to which it is mounted so as to be securely latched thereon. As previously indicated, a user U typically opens the drawer 18 by placing his fingers F under the edge of the trim member 22 whereby his fingers F will come into contact with the actuator bar 36 located in the body of the handle 10. The user U then presses upwardly on the actuator bar 36, which causes at least one hook 38, which is attached to the bar 36, to be upwardly displaced or disengaged from its associated keeper 40. This mechanical function allows a user U to open doors, cabinets, and other enclosed structures with a quick, upward motion of a single hand, so that the drawer easily unfastens and slides out. This enables two motions—the unlatching of the drawer 18 and the pulling out of the drawer 18—to be seamlessly combined into one action to accomplish the intended purposes of the invention.

Turning again to the front view of the handle 10 seen in FIG. 1, it can now be appreciated that the invention provides an aesthetic advantage in that its latching mechanism is concealed behind the front panel 26 of the drawer 18 so that when the drawer 18 is viewed from the front, the viewer sees only the front panel 26 with the rectangular-shaped opening in which the handle sits. Because the latching mechanism is hidden, almost any kind of latch mechanism and keeper 40 may be used, including the conventional L-shaped keepers fixedly adhered to the inner walls of the cabinet depicted in FIG. 2 or a single tubular keeper extending between the walls of the cabinet 16, which is the preferred embodiment of the invention for doors 30.

Turning now to FIG. 3 for greater detail, the latching mechanism itself is made up principally of three operative parts including the actuator bar 36, a connecting link 44, and the hook 38. The keeper 40 is located on a side wall of the cabinet adjacent the hook 38. In the preferred embodiment of the invention, the frame 36 is generally C-shaped in cross-section, elongated, and includes an upper wall 48, a lower wall 50, and a back 52. The upper wall 48 has an inner surface (not shown) and defines a lip or trim member 22 which extends substantially downwardly and inwardly to create a space within the frame 36 and along the length thereof for nesting a biasing member securely therein.

The elongated actuator bar 36 is preferably L-shaped in cross-section and dimensioned to be received in the frame 46 of the handle 10. It is now seen how the user U can grasp the handle 10 at any point along the extent of the actuator bar 36. The actuator bar 36 preferably has an upper 56 and lower leg 58, the upper leg 56 defining an upper surface for supporting the biasing member, preferably a spring 60, thereon. However, the spring 60 is fixedly attached to the frame 46 on the inner surface of the upper wall 48. In the embodiment of the invention for doors (depicted in FIG. 4) only one such biasing element is used; however any appropriate biasing element may be employed including a leaf spring or mechanical assembly for urging the actuator 36 downwards. The spring 60 has an inner diameter, a top portion, and a bottom portion, the inner diameter being greater at the top portion than at the bottom portion, helping to insure that the spring 60 fits neatly and remains in place under the trim member 22. The spring 60 is fixedly attached to the inner surface of the upper wall 48 by a fastener, which, in the preferred embodiment, is foam tape 62, disposed so as to adhesively hold the top portion of the spring 60 against the upper wall 48. The spring 60 urges the actuator 36 downwards to carry the hook 38 into reversible engagement with the keeper 40.

The lower wall 50 of the frame 46 includes at least one aperture 64 for receiving a bolt 68 and for mounting the frame 58 to the support structure 28. And so the frame 52 is dimensioned to snugly receive the actuator bar 36 and for slidably mounting at least one hook 38 to the rear surface of its back wall 52. The back 52 includes at least one elongated oval aperture or slot 66 for receiving a bolt therethrough for interconnecting the latch member or hook 38 to the actuator bar 36 to allow the hook 38 to slide along the length of the slot 66. The hook 38 is configured to frictionally, reliably, and securely engage with the keeper 40.

The arrows at 42 point upward to show the direction of movement of the hooks 38 with respect to the keeper 40 when the handle 10 is actuated and indicate the minimal amount of effort needed for a person to use the handle 10. As the American population continues to age and the rights of individuals with disabilities are increasingly recognized, more and better ways are being found to help individuals in their daily tasks of living such as opening and closing cabinet doors and drawers. Persons with osteoarthritis and other diseases can experience exquisite pain upon engaging in such basic manual tasks as turning a door knob or pushing a button. The present invention provides an important solution to this problem in the form of an apparatus for easily opening a door, drawer, or other construction element, which gives the owner the comfort of knowing that it is also dependable, reliable, and secure.

It is to be understood that the present invention is not limited to the embodiments described above, but encompasses any and all embodiments within the scope of the following claims.

We claim:

1. A handle for doors and drawers comprising:

an elongated actuator bar and at least one spring, said bar including an upper surface for supporting said spring thereon;

an elongated frame including at least one wall, said wall having front and rear surfaces and defining a trim member extending from an edge thereof, said wall including at least one aperture for receiving a bolt and for mounting said frame to a support structure, said frame being dimensioned for receiving said actuator bar;

at least one latch member and at least one keeper, said frame configured for slidably mounting said at least one latch member to the rear surface of said frame, said frame comprising at least one elongated slot, a bolt extending through said elongated slot to interconnect said at least one latch member to said actuator bar to allow said at least one latch member to slide vertically along the slot, said at least one latch member being configured to engage with said at least one keeper; and said spring being fixed to said inner surface of said wall by a fastener, said spring arranged and configured for urging said actuator bar downwardly and to carry said at least one latch member into engagement with said at least one keeper;

whereby a user's urging said actuator bar upwardly against said spring causes said at least one latch member to slide upwards and become disengaged from said at least one keeper.

2. The handle for doors and drawers recited in claim 1, in combination with a cabinet, said cabinet having at least one keeper mounted thereon and at least one drawer, said drawer comprising a drawer body and a front plate, said front plate defining said support structure for mounting said handle.

3. The handle for doors and drawers recited in claim 1, in combination with a drawer, said drawer comprising a front plate, said front plate being provided with a cross piece extending behind said front plate to define said support structure for supporting said handle above said front plate.

4. The handle for doors and drawers recited in claim 1, wherein said fastener is foam tape.

5. The handle for doors and drawers recited in claim 1, in combination with a drawer, said drawer comprising a front plate, said front plate being provided with a cross piece extending behind said front plate to define said support structure for supporting said handle above said front plate, and wherein said frame and said trim member define a space for nesting said spring therebetween.

6. The handle for doors and drawers recited in claim 1, wherein said trim member extends along the length of said handle, said trim member extending substantially downwardly and inwardly to define a space for nesting said spring therein.

7. The handle for doors and drawers recited in claim 1, in combination with a door, said door defining a generally planar support structure for mounting said handle.

8. A handle for doors and drawers comprising:

an elongated actuator bar and at least one spring, said bar being generally L-shaped in cross-section and defining an upper and lower leg, said upper leg having an upper surface for supporting said spring thereon;

an elongated frame generally C-shaped in cross-section and including an upper wall, a lower wall, a back, and configured to define an elongated open portion for manual access to said actuator bar, said upper wall having an inner surface and defining a trim member extending from an edge of said upper wall, said back including front and rear surfaces, said lower wall comprising at least one aperture for receiving a bolt and for mounting said frame to a support structure;

at least one hook and a keeper therefor;

said frame being dimensioned for receiving said actuator bar and for slidably mounting said hook to the rear surface of said back, said back comprising at least one vertically-oriented, oval aperture, a bolt extending through said oval aperture to interconnect said hook to said actuator bar to allow said hook to slide along the length thereof toward said upper wall and said lower wall, said hook being configured to frictionally engage with said keeper;

said spring being fixed to said inner surface of said upper wall by a fastener, said spring arranged and configured for urging said actuator bar downwards when said actuator bar is manually lifted upwards and to carry said latch member into engagement with said keeper, said trim member extending downwardly to define a space within said frame for nesting said spring therein.

9. The handle for doors and drawers recited in claim 8, in combination with a drawer, said drawer comprising a drawer body and a front plate, said front plate defining said support structure for mounting said handle.

10. The handle for doors and drawers recited in claim 8, in combination with a cabinet, said cabinet having at least one keeper mounted thereon and at least one drawer, said drawer comprising a drawer body and a front plate, said front plate defining said support structure for mounting said handle.

11. The handle for doors and drawers recited in claim 8, in combination with a drawer, said drawer comprising a front plate, said front plate being provided with a cross piece extending behind said front plate to define said support surface for supporting said handle above said front plate.

12. The handle for doors and drawers recited in claim 8, wherein said fastener is foam tape.

13. The handle for doors and drawers recited in claim 8, in combination with a door, said door defining a generally planar support structure for mounting said handle thereon.

* * * * *